US006546597B2

(12) United States Patent
Atalla et al.

(10) Patent No.: US 6,546,597 B2
(45) Date of Patent: Apr. 15, 2003

(54) HOLLOW APPLIANCE HANDLE

(75) Inventors: Samir Atalla, Oakville (CA); Wilfred Wong, Oakville (CA); James Matthew Yates, Dundas (CA); Nedo Banicevic, Hamilton (CA)

(73) Assignee: Camco Inc., Mississauga (CA)

( * ) Notice: Subject to any disclaimer, the term of this patent is extended or adjusted under 35 U.S.C. 154(b) by 0 days.

(21) Appl. No.: 09/988,081

(22) Filed: Nov. 19, 2001

(65) Prior Publication Data

US 2002/0184734 A1 Dec. 12, 2002

(30) Foreign Application Priority Data

Jun. 7, 2001 (CA) ..... 2349800

(51) Int. Cl.[7] ..... E05B 1/00; E05B 5/00

(52) U.S. Cl. ..... 16/436; 16/412; 16/415; 16/444; 16/DIG. 19

(58) Field of Search ..... 16/436, 430, 412, 16/415, 419, 420, 443, 444, DIG. 12, DIG. 18, DIG. 19, DIG. 5; 312/405, 244, 321.5; 49/460; 74/543, 548, 558.5; 411/378, 424; 248/222.14, 251; 403/245, 246, 362, 408.1

(56) References Cited

U.S. PATENT DOCUMENTS

| | | | | | |
|---|---|---|---|---|---|
| 3,183,549 | A | | 5/1965 | Hammesfahr | |
| 3,736,621 | A | * | 6/1973 | Szabo | 16/435 |
| 3,995,349 | A | | 12/1976 | Roberts et al. | |
| 4,021,072 | A | | 5/1977 | Belanger | |
| 4,067,602 | A | * | 1/1978 | Ahlisch et al. | 296/71 |
| 4,087,141 | A | * | 5/1978 | Roberts | 312/348.6 |
| 4,261,078 | A | * | 4/1981 | Edwards et al. | 16/409 |
| 4,922,576 | A | * | 5/1990 | Weidner et al. | 16/413 |
| 4,926,523 | A | * | 5/1990 | Carlson et al. | 16/412 |
| 5,303,451 | A | | 4/1994 | Graviss et al. | |
| 5,402,553 | A | | 4/1995 | Goetz et al. | |
| 5,412,839 | A | * | 5/1995 | McCollom | 16/430 |
| 5,675,867 | A | | 10/1997 | Howie, Jr. | |

FOREIGN PATENT DOCUMENTS

| | | | |
|---|---|---|---|
| FR | 2637056 A | * | 3/1990 |
| JP | 2000-97549 A | * | 4/2000 |
| JP | 2201-30291 A | * | 2/2001 |
| JP | 2002-5561 A | * | 1/2002 |

* cited by examiner

*Primary Examiner*—Chuck Y. Mah

(57) ABSTRACT

A hollow full grip gas assist appliance handle for use in a household refrigerator has a hollow full grip portion comprising a thermal plastic material that is a 10–40% glass filled homopolymer polypropylene. The distal ends of the hollow grip portion are solid thermoplastic material which encases a metal insert that is adapted to be secured to a side panel of the refrigerator door. The hollow appliance handle provides a solid feel or touch handle along it's full grip portion with solid distal end portions subject to little bending movement due to the metal inserts permitting the door handle to be firmly attached to the side panels of the refrigerator door.

20 Claims, 3 Drawing Sheets

HOLLOW APPLIANCE HANDLE

FIELD OF THE INVENTION

The present invention relates a hollow appliance handle and in particular relates to a full grip gas assist refrigerator door handle.

BACKGROUND OF THE INVENTION

There has been a preference among consumers for handles of household refrigerators that have a soft feel or touch. In the past the soft touch was achieved to some degree by the use of multi-component assemblies including soft inserts.

More recently "soft touch" refrigerator handles have been manufactured by injection molding of a relatively thick covering of an elastomer around a channel-shaped metal reinforcement member that extends the length of the door handle. This handle is expensive to manufacture and requires a relatively large amount of elastomer molded around the metal reinforcement member to provide the "soft" touch or feel.

Even more recently, handles for household refrigerators have been developed comprising a hollow tubular metal core having an outer coating of thermoplastic surrounding the tubular metal to reduce the amount of elastomer or thermoplastic coating. However, the tubular metal provides a reinforcement that extends the length of the refrigerator handle and still provides a soft feel.

It is an object of the present invention to provide an improved hollow handle assembly for household refrigerators that does not require a metal stiffener or tubular member extending along its full length.

It is another object of the present invention to provide such an improved handle assembly which provides a full grip solid feel to the user while providing rigid connection at its distal ends to the refrigerator.

It is still another object to provide such an improved handle assembly which is simple in construction and has a solid feel in application along its central full grip portion.

SUMMARY OF THE INVENTION

The present invention relates to a full grip door handle that has a hollow grip portion with two distal end portions which are preferably a solid material and encase a metal insert. The metal insert reinforces the distal end portions of the handle to permit for the securement of the handle relative to an appliance and limit bending movement relative thereto at the distal end portions. The hollow full grip portion of the door handle comprises a solid feel non-bending thermoplastic material and has no tubing or metal reinforcement extending along it's length between the two distal closed end portions.

In accordance with one aspect of the present invention there is provided an appliance comprising a cabinet and a door mounted to provide access to the interior of the cabinet. The door includes a front panel and a rear panel joined by elongated side panels. The appliance includes an elongate handle comprising two thermoplastic distal closed end portions extending from a full grip portion. The grip portion consists of a thin walled, hollow and molded thermoplastic material. The two distal closed end portions each have a first surface that is in abutment with the door front panel to position the full grip portion overlapping and spaced from the door front panel. Each of the two distal end portions has a second surface substantially orthogonal to the first surface attached to and abutting one of the door side panels. The appliance has metal inserts each encased in a respective one of the distal end portions for reinforcing the handle. Each of the inserts has a first member that extends substantially parallel to the one door side panel and a second member that projects into the distal end portion from the first member.

BRIEF DESCRIPTION OF THE DRAWINGS

For a better understanding of the nature and objects of the present invention, reference may be had to the accompanying diagrammatic drawings in which.

DETAILED DESCRIPTION OF THE PREFERRED EMBODIMENT

Figure 1:
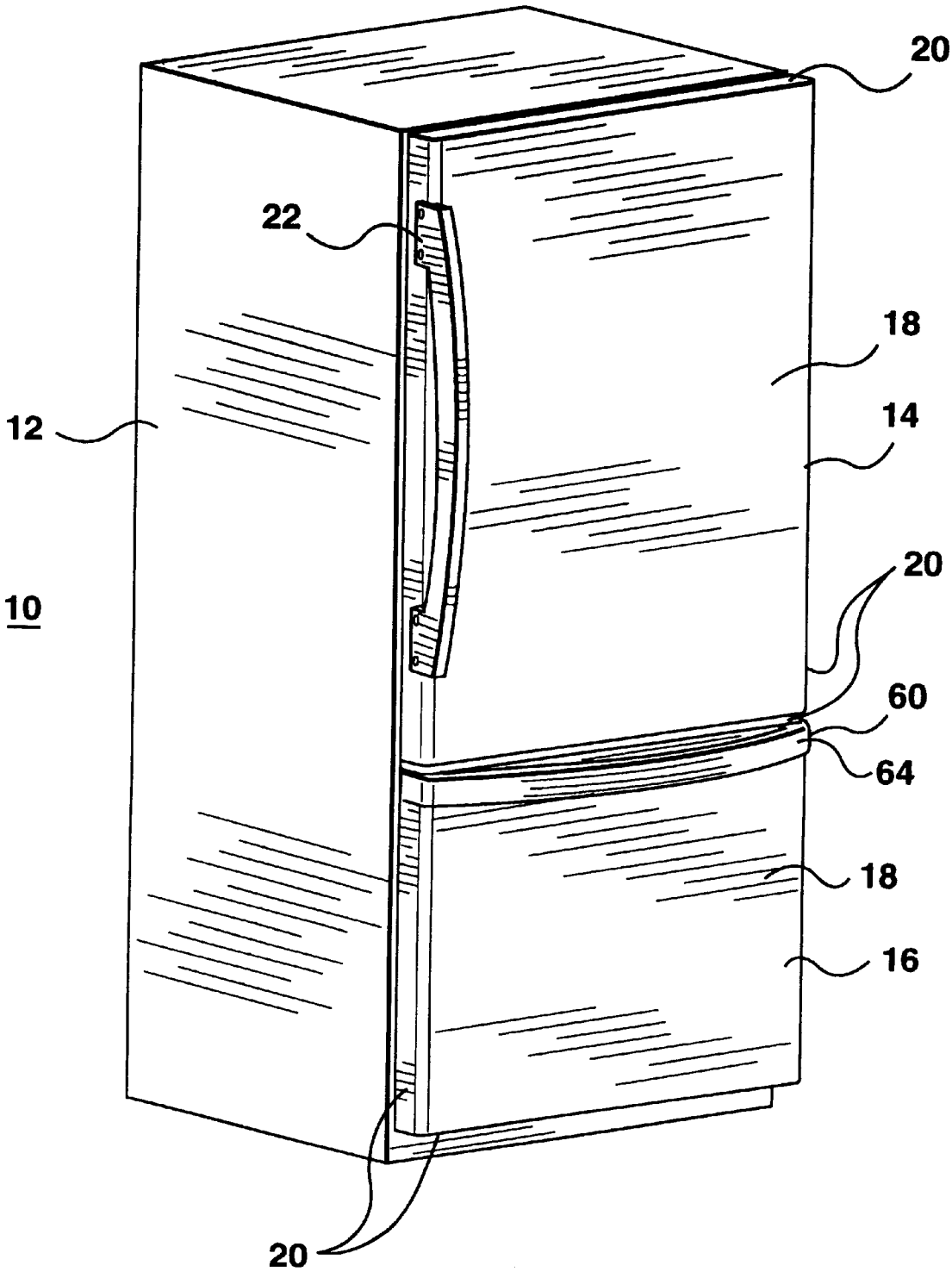
FIG. 1 is a perspective view of a bottom mount refrigerator appliance showing two full grip door handles.
Figure 2:
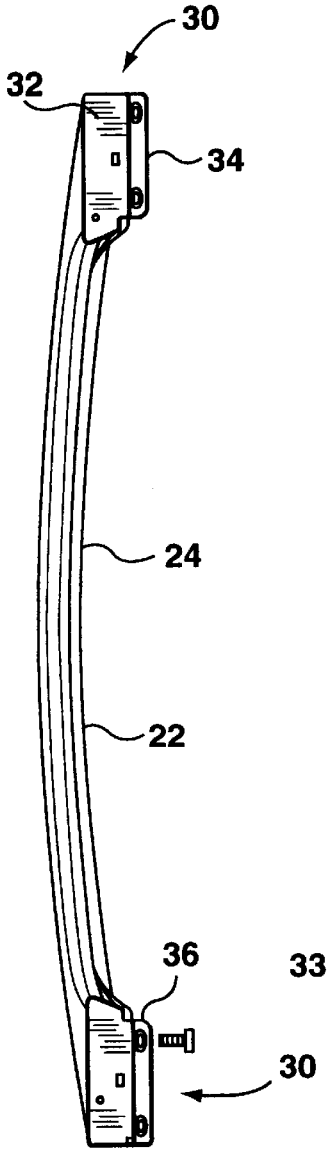
FIG. 2 is a perspective view of upper cabinet door handle.
Figure 3:
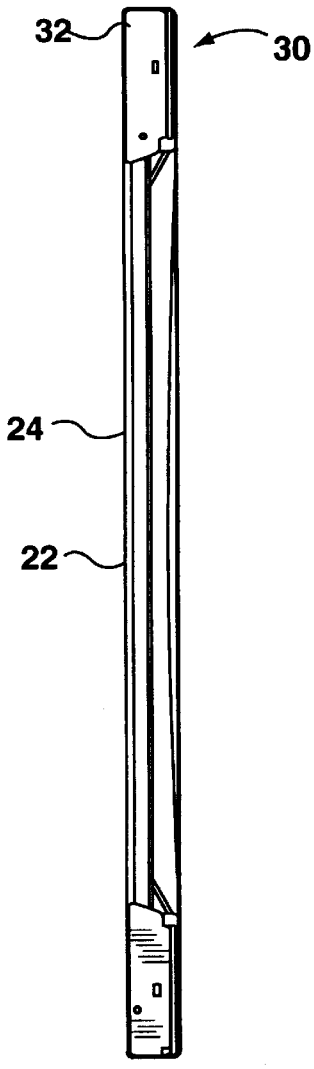
FIG. 3 is an end view of the handle of FIG. 2.
Figure 4:
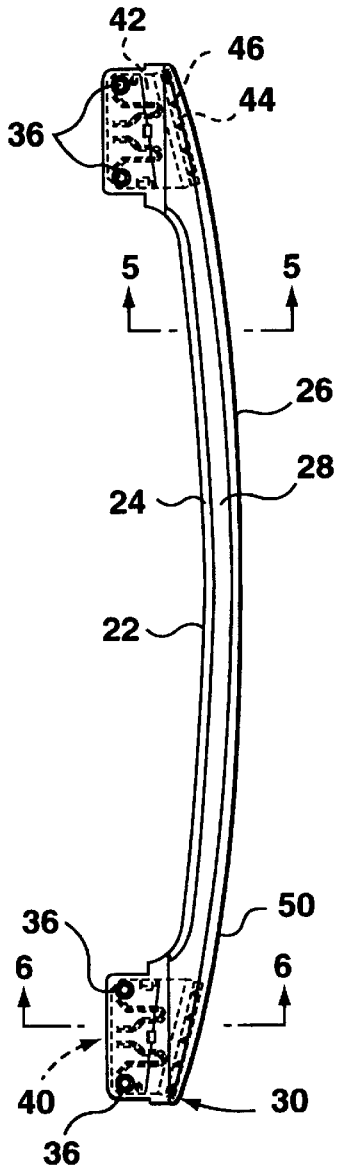
FIG. 4 is a side view of the handle of FIG. 2 showing an insert in broken lines.
Figure 5:
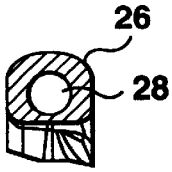
FIGS. 5 and 6 are sectional views through FIG. 4 taken at sections 5—5 and 6—6.
Figure 6:
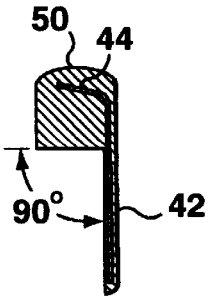
Figure 7:
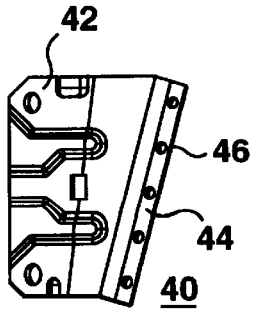
FIG. 7 is a perspective view of one of the metal inserts in the handle of FIG. 4.
Figure 8:
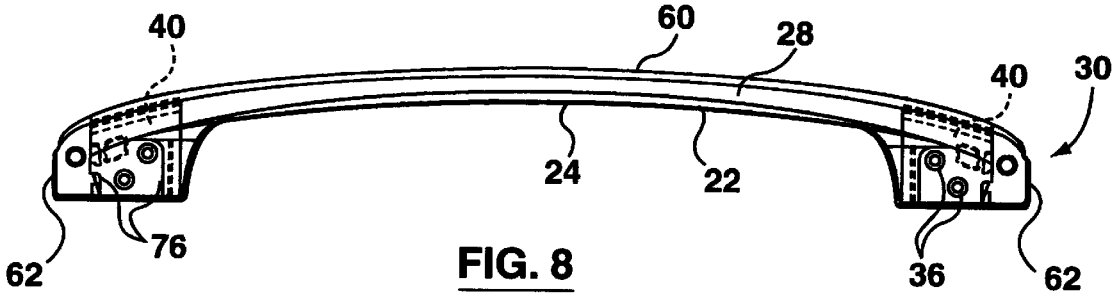
FIG. 8 is a perspective view of the lower cabinet handle.
Figure 9:
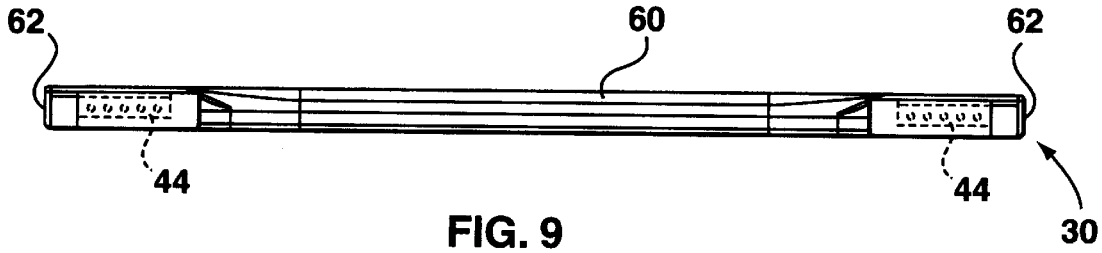
FIG. 9 is an end view of the handle of FIG. 8.

In FIG. 1, a bottom mount refrigerator 10 has a cabinet 12 with an upper fresh food compartment closed by door 14 mounted to the cabinet 12. The refrigerator 10 has a lower freezer compartment closed by door or drawer 16 mounted to the cabinet 12. The doors 14 and 16 provide access to the interior of the cabinet 12. The doors 14 and 16 each include a front panel 18 and a rear panel (not shown) joined by elongated side panels 20.

Attached to a side panel 20 of door 14 is handle 22 and to a top side panel 20 of door 16 is a handle 60. Handles 22 and 60 are constructed in accordance with the present invention.

The handles 22 and 60 are now described and like features for each of these handles will have the same numeral designation.

Door handle 22 comprises a grip portion 24 which is made of a thin walled hollow and molded thermoplastic material 26. Extending along the length of the grip portion 24 is a hollow passageway 28. The thin walled thermoplastic material 26 comprises a 10–40% glass filled homopolymer polypropylene. During the manufacture of the handle 22, the homopolymer polypropylene is blow molded into a die and the gas pressure is utilized to force the thermoplastic material against the mold until it cures forming a solid inflexible door grip.

The grip portion 24 is shown to be spaced from and overlapping a front panel 18 of a door 14. By having the grip portion 24 spaced from the door panel 18, a user may insert the fingers completely around the door portion or the grip and the grip is thus considered to be a full grip.

The elongated curved handle 22 has two thermoplastic distal closed end portions 30 which extend from the full grip portion 24. The distal end portions 30 are preferably a solid thermoplastic material and in this instance a homopolymer polypropylene. The two distal closed end portions 30 have a first surface 32 that abuts the door front panel 18 so as to position the full grip portion 24 in the spaced apart overlapping relationship from the door front panel 18. The two distal end portions 30 further have a second surface 34 which is substantially orthogonal to the first surface 32 and is adapted to abut one of the side panels 18 of the door 14.

The distal end portions 30 each have mounting apertures 36 passing through the second surface 34. Threaded fasteners 33 pass through apertures 36 into one of the side panel 18 so to firmly attach the distal end portions 30 to the door side panel 18.

To reinforce the attachment of the full grip handle 24 to the side panels 18 of the door 14, the handle further includes metal inserts 40 each of which is encased in a respective one of the distal end portions 30 so as to reinforce the handle. The distal end portions 30 are molded so that thermoplastic surrounds the metal inserts 40 completely. Each of the metal inserts 40 has a first member 42 that extends substantially parallel to the one door side panel 18 and a second member 44 that projects into the distal end portion 30 from the first member 42. The second member 44 of the insert 40 projects into the distal end portions 30 spaced from and angled substantially parallel to the first surface 32 of the distal end portion 30. The second member 44 of the insert 40 has openings 46 spaced along it's length through which the molded thermoplastic flows during the handle formation. The second member 44 of the insert 40 has an outer curvature corresponding to the outside surface 50 of the distal end portion 32.

The freezer handle 60 is substantially similar to that of the refrigerator door handle 22. However, the freezer handle has the difference that the distal end portions 30 include a molded curved flange 62 that is adapted to extend around the corner 64 of the front door panel 18 and one of the side door panels 20.

Figure 10:
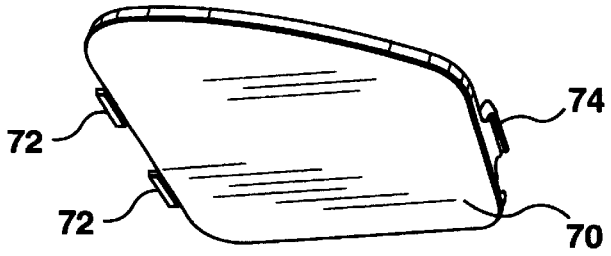
FIG. 10 is a perspective view of a covering cap.

FIG. 10 shows a cap member 70 having two tongues 72 and a forward clip 74 which are adapted to be inserted into corresponding apertures 76 in the distal end portions so as to lock the cap 70 against the distal end portion 30 of the freezer door 60 so as to cover the fastening or fasteners.

Certain preferred embodiments of the invention have been described in detail. From a reading of this disclosure, obvious modifications will be evident to those skilled in the art without departing from the spirit of the invention disclosed or from the scope of the appended claims.

What we claim is:

1. An appliance comprising:

a cabinet and a door mounted to provide access to the interior of the cabinet, the door including a front panel and a rear panel joined by elongated side panels;

an elongate handle comprising two thermoplastic distal closed end portions extending from a full grip portion, the full grip portion consisting of a thin walled, hollow and molded thermoplastic material, the two distal closed end portions each having a first surface that is positioned in abutment with the door front panel to position the full grip portion overlapping and spaced from the door front panel, and each of the two distal end portions having a second surface substantially orthogonal to the first surface attached to and abutting one of the door side panels; and, metal inserts each encased in a respective one of the distal end portions for reinforcing the handle, and each of the inserts having a first member that extends substantially parallel to the one door side panel and a second member that projects into the distal end portion from the first member.

2. The appliance of claim 1 wherein the second member of the insert projects into the distal end portion spaced from, and at an angle substantially parallel to, the first surface of the distal end portion.

3. The appliance of claim 2 wherein the second member of the insert has openings spaced along its length through which the molded thermoplastic material flows during handle formation.

4. The appliance of claim 3 wherein the distal end portions are solid.

5. The appliance of claim 1 wherein the second member of the insert has a curvature relative to the first surface of the distal end portion.

6. The appliance of claim 1 wherein the distal end portions are molded about both the first and second members of the metal insert to fully encase the metal insert.

7. The appliance of claim 1 wherein the distal end portions include a molded curved flange adapted to extend around a corner between the door front panel and the one door side panel.

8. The appliance of claim 1 wherein the distal end portions each have mounting apertures passing therethrough and through the first member of the insert and fasteners pass through the mounting apertures to attach the distal end portions to the one door side panel.

9. The appliance of claim 8 further including a cap member mounted to an outer surface of the distal end portion adjacent the one door side panel.

10. The appliance of claim 1 wherein the thermoplastic material is a 10–40% glass filled homopolymer polypropylene.

11. A handle for a refrigerator having cabinet and a door mounted to provide access to the interior of the cabinet, the door including a front panel and a rear panel joined by elongated side panels; the handle comprising:

an elongate handle comprising two distal closed end portions extending from a hollow full grip portion, the hollow full grip portion consisting of a hollow and molded thermoplastic material, the two distal closed end portions each having a first surface that is in abutment with the door front panel to position the full grip portion overlapping and spaced from the door front panel, and each of the two distal end portions having a second surface substantially orthogonal to the first surface, attached to and abutting one of the door side panels; and, metal inserts each encased in a respective one of the distal end portions for reinforcing the handle, and each of the inserts having a first member that extends substantially parallel to the one door side panel and a second member that projects into the distal end portion from the first member.

12. The appliance of claim 11 wherein the second member of the insert projects into the distal end portion spaced from, and at an angle substantially parallel to, the first surface of the distal end portion.

13. The appliance of claim 12 wherein the second member of the insert has openings spaced along its length through which the molded thermoplastic material flows during handle formation.

14. The appliance of claim 13 wherein the distal end portions are solid.

15. The appliance of claim 11 wherein the second member of the insert has a curvature relative to the first surface of the distal end portion.

16. The appliance of claim 11 wherein the distal end portions are molded about both the first and second members of the metal insert to fully encase the metal insert.

17. The appliance of claim 11 wherein the distal end portions include a molded curved flange adapted to extend around a corner between the door front panel and the one door side panel.

18. The appliance of claim 11 wherein the distal end portions each have mounting apertures passing therethrough and through the first member of the insert and fasteners pass through the mounting apertures to attach the distal end portions to the one door side panel.

19. The appliance of claim 18 further including a cap member mounted to an outer surface of the distal end portion adjacent the one door side panel.

20. The appliance of claim 11 wherein the thermoplastic material is a 10–40% glass filled homopolymer polypropylene.

* * * * *